US006867385B2

(12) United States Patent
Stoving et al.

(10) Patent No.: US 6,867,385 B2
(45) Date of Patent: Mar. 15, 2005

(54) SELF-FIXTURING SYSTEM FOR A VACUUM INTERRUPTER

(75) Inventors: Paul N. Stoving, Oak Creek, WI (US); E. Fred Bestel, West Allis, WI (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 10/370,105

(22) Filed: Feb. 21, 2003

(65) Prior Publication Data

US 2004/0164052 A1 Aug. 26, 2004

(51) Int. Cl.[7] ..... H01H 33/66
(52) U.S. Cl. ..... 218/134; 218/118
(58) Field of Search ..... 218/118, 134, 218/139, 10, 121, 135–138

(56) References Cited

U.S. PATENT DOCUMENTS

| | | | | |
|---|---|---|---|---|
| 3,657,502 A | * | 4/1972 | Cherry et al. | 218/125 |
| 4,071,727 A | | 1/1978 | Crouch et al. | |
| 4,077,114 A | * | 3/1978 | Sakuma | 218/130 |
| 4,394,554 A | * | 7/1983 | Warabi et al. | 218/134 |
| 4,478,347 A | * | 10/1984 | Cherry et al. | 218/136 |
| 4,704,506 A | | 11/1987 | Kurosawa et al. | |
| 4,839,481 A | | 6/1989 | Nash et al. | |
| 4,871,888 A | | 10/1989 | Bestel | |
| 4,933,518 A | * | 6/1990 | Yin | 218/134 |
| 4,982,059 A | | 1/1991 | Bestel | |
| 5,004,877 A | | 4/1991 | Yin | |
| 5,099,093 A | | 3/1992 | Schels et al. | |
| 5,252,913 A | | 10/1993 | Falkowski et al. | |
| 5,777,287 A | | 7/1998 | Mayo | |
| 5,793,008 A | | 8/1998 | Mayo et al. | |
| 5,804,788 A | | 9/1998 | Smith | |
| 6,163,002 A | | 12/2000 | Ahn et al. | |
| 6,506,992 B2 | * | 1/2003 | Kim | 218/123 |
| 2002/0043514 A1 | | 4/2002 | Kim, II | |

OTHER PUBLICATIONS

Holec HH Vacuum Interrupters, "Taking Care of Your Power", 6 pages, (no date).

* cited by examiner

*Primary Examiner*—Lincoln Donovan
*Assistant Examiner*—M. Fishman
(74) *Attorney, Agent, or Firm*—Fish & Richardson P.C.

(57) ABSTRACT

A vacuum interrupter includes end covers having a curved or looped portion, which serves to connect a coil segment of the vacuum interrupter to a ceramic envelope of the vacuum interrupter, and thereby help maintain a vacuum seal for the interrupter. The curved portion acts as a spring when the vacuum interrupter is exposed to heat, thereby absorbing any expansion or contraction in the length of the vacuum interrupter due to the heating or cooling. The curved portion also protects an end of the ceramic envelope from any build-up of metallic arcing products and eliminates the need for elaborate fixturing during assembly. Additionally, a guide may be affixed to the end cover, the guide having ears which ride in a slot in a moving rod of the vacuum interrupter, to thereby prevent a twisting of a bellows of the interrupter during a brazing process. Thus, no elaborate fixturing is necessary to prevent this twisting.

19 Claims, 13 Drawing Sheets

SELF-FIXTURING SYSTEM FOR A VACUUM INTERRUPTER

TECHNICAL FIELD

This description relates to vacuum fault interrupters.

BACKGROUND

Conventional vacuum fault interrupters exist for the purpose of providing high voltage fault interruption. Such vacuum fault interrupters, which also may be referred to as "vacuum interrupters," generally include a stationary electrode assembly having an electrical contact, and a movable electrode assembly on a common longitudinal axis with respect to the stationary electrode assembly and having its own electrical contact. The movable electrode assembly generally moves along the common longitudinal axis such that the electrical contacts come into and out of contact with one another. In this way, vacuum interrupters placed in a current path can be used to interrupt extremely high current, and thereby prevent damage to an external circuit.

SUMMARY

In one general aspect, an end cover for a vacuum interrupter includes a substantially annular first portion that is attached to a substantially cylindrical hollow body of the vacuum interrupter. The end cover also includes a concave second portion that is concentric to the first portion and concave with respect to the body, and a substantially annular third portion that is concentric to the first portion.

Implementations may include one or more of the following features. For example, the body may be primarily composed of ceramic.

At least a first section of the first portion may be substantially in a plane of the third portion. In this case, all of the first portion may be substantially in the plane of the third portion, and substantially perpendicular to the body. Alternatively, the second section of the first portion may be tapered away from the plane of the third portion, in a direction of the concave second portion, and attached to the body.

The end cover may also include a fourth portion that extends over the second portion.

The third portion may be attached to a substantially cylindrical electrode support structure. The support structure and the body may be concentric.

A substantially annular hollow guide may be attached to the third portion. The guide may include protruding portions extending into an interior of the guide. The protruding portions may ride in corresponding slots formed in a moving rod that is slidable through the end cover and the guide and operable to actuate a moving electrode of the vacuum interrupter. The protruding portions may be composed primarily of steel.

The third portion may be attached to, and sandwiched between, a support structure for an electrode of the vacuum interrupter and a female-threaded metallic base.

In another general aspect, a vacuum interrupter includes an end cover that includes a substantially circular outer perimeter portion and an inner portion that is concentric to the outer perimeter portion. A curved portion protrudes into a body of the vacuum interrupter and joins the outer perimeter portion to the inner portion.

Implementations may include one or more of the following features. For example, the inner portion may be substantially within a plane, and at least a first portion of the outer perimeter portion may be substantially within the plane of the inner portion. In this case, substantially all of the outer perimeter portion may be substantially within the plane of the inner portion. Alternatively, a second portion of the outer perimeter portion may be tapered away from the plane of the inner portion, in a direction of the curved portion, and attached to a substantially cylindrical hollow body of the vacuum interrupter.

The outer perimeter portion and the inner portion may be substantially perpendicular to a substantially cylindrical hollow body of the vacuum interrupter. The vacuum interrupter may also include a covering portion that extends over the curved portion.

The inner portion may be attached to a substantially cylindrical electrode support structure. The support structure and the body may be concentric.

A substantially annular hollow guide as discussed above may be attached to the inner portion.

The inner portion may be attached to, and sandwiched between, a support structure for an electrode of the vacuum interrupter and a female-threaded metallic base.

The details of one or more implementations are set forth in the accompanying drawings and the description below. Other features will be apparent from the description and drawings, and from the claims.

DETAILED DESCRIPTION

Figure 1:
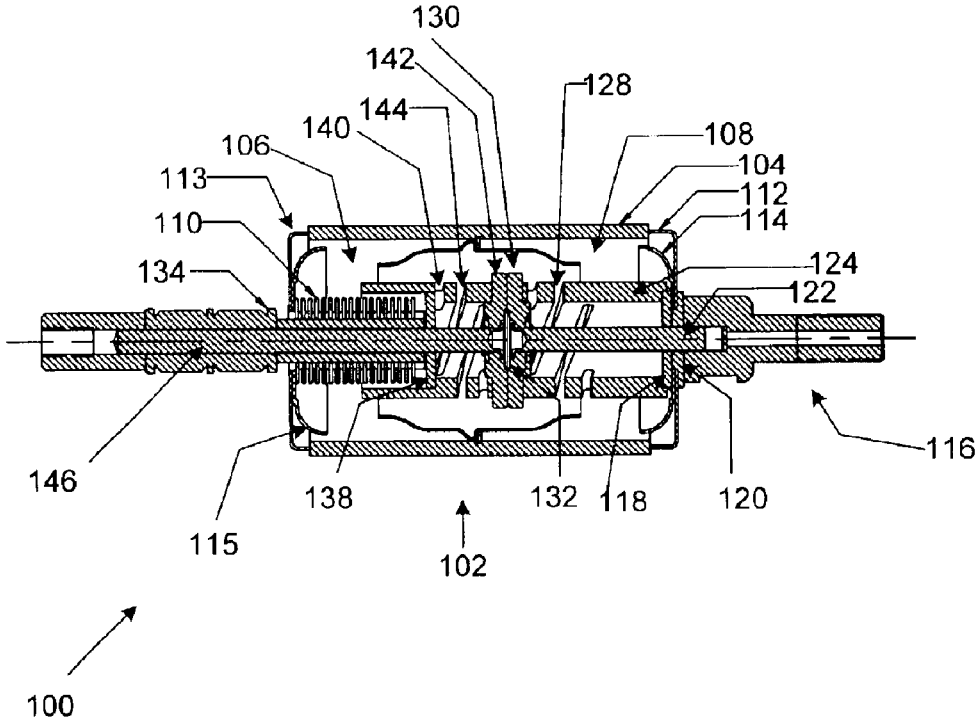
FIG. 1 is a cutaway side view of a vacuum interrupter.

FIG. 1 demonstrates a vacuum interrupter 100 that includes a vacuum vessel 102. Vacuum vessel 102 is designed to maintain an integrity of a vacuum seal with respect to components enclosed therein. Part of vacuum vessel 102 is a ceramic material 104, which is generally cylindrical in shape. Vacuum vessel 102, including ceramic material 104, contains a movable electrode structure 106, which, as described below, is operable to move toward and away from a stationary electrode structure 108, to thereby permit or prevent a current flow through the vacuum interrupter 100. A bellows 110 within vacuum vessel 102 is composed of a convoluted, flexible material, and is used to maintain the integrity of the vacuum vessel 102 during a movement of the movable electrode structure 106 toward or away from the stationary electrode structure 108, as discussed in more detail below.

The stationary electrode structure 108 further includes a tubular coil conductor 124 in which slits 128 are machined, and an electrical contact 130. The electrical contact 130 and tubular coil conductor 124 are mechanically strengthened by a structural support rod 122. An external conductive rod 116 is attached to the structural support rod 122 and to conductor discs 118 and 120.

The movable electrode structure 106 has many functionally-similar parts as the stationary electrode structure 108. In particular, structure 106 includes a tubular coil conductor 140 in which slits 144 are machined, and an electrical contact 142. Structure 106 also includes a conductor disc 138 attached to the bellows 110 and to the movable coil conductor 140 such that the electrical contact 142 may be moved into and out of contact with the electrical contact 130. The movable electrode structure 106 is mechanically strengthened by support rod 146, which extends out of the vacuum vessel 102 and is attached to a moving rod 134. The moving rod 134 and the support rod 146 serve as a conductive external connection point between the vacuum interrupter and an external circuit, as well as a mechanical connection point for actuation of the vacuum interrupter.

A vacuum seal at each end of the ceramic portion 104 is provided by metal end caps 112 and 113, which are brazed to a metallized surface on the ceramic. Along with the end cap 112, an end shield 114 protects the integrity of the vacuum interrupter, and is attached between conductor discs 118 and 120. Similarly, an end shield 115 is positioned between bellows 110 and end cap 113.

In the vacuum fault interrupter of FIG. 1, current may flow, for example, from coil conductor 124, electrical contact 130, and electrical contact 142 to coil conductor 140, so that, with respect to contacts 130 and 142, the current may flow straight through from the ends of slots 128 and 144. This current becomes an arc current when electrode structure 106 is separated from electrode structure 108.

In FIG. 1, slots 128 and 144 that are cut into copper coil segments 124 and 140 generate a magnetic field parallel to the common longitudinal axis of the electrode structures (an axial magnetic field). The presence of the uniform axial magnetic field causes a diffuse arc between the electrical contacts when separated, which advantageously produces low electrical contact wear and is easy to interrupt.

Figure 2:
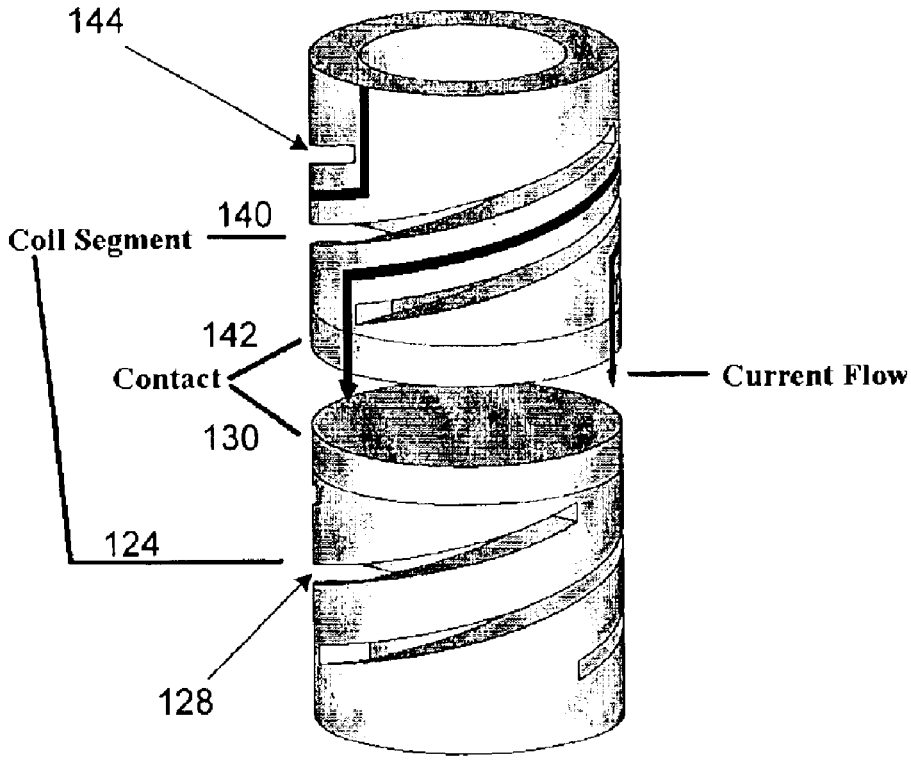
FIG. 2 is a perspective view of coil segments of the vacuum interrupter of FIG. 1.

FIG. 2 illustrates coil segments 124 and 140 and their respective slots 128 and 144. As shown in FIG. 2, current flow between the coil segments generally takes the shortest possible path (i.e., current enters contact 142 after the end of each slot 144). This results from the flush end of coil segment 140 being connected directly to contact 142. As a result of this current flow, magnetic flux (and thereby a magnitude of the corresponding magnetic field) is generally reduced. This reduction in the axial magnetic field reduces an ability of the field to keep the arc diffuse and uniform between the contacts, and is therefore undesirable.

Figure 3:
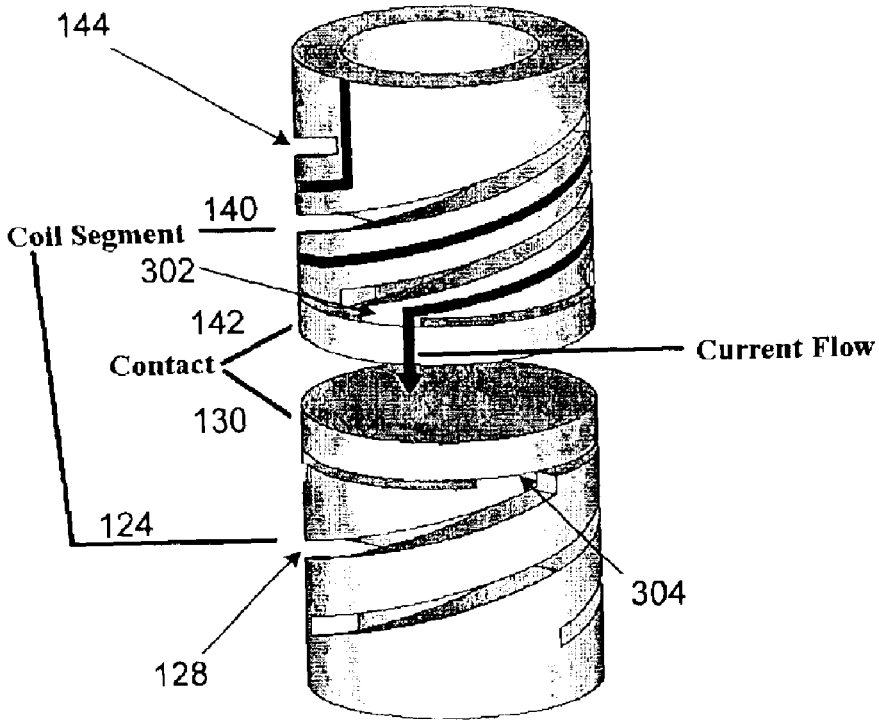
FIG. 3 is a perspective view illustrating a technique for increasing a current path between coil segments and electrical contacts of the vacuum interrupter of FIG. 1.

FIG. 3 demonstrates a technique for increasing a current path between the coil segments and the electrical contacts. In FIG. 3, metal footings or clips 302 and 304 are placed at the ends of the coil segments 124 and 140. The increased length of the current path leads to a higher magnetic field, but also results in difficulty in aligning the footing segment 302 and 304. Moreover, although the magnitude of the axial magnetic field is increased by the technique of FIG. 3, the fact that the current enters contacts 142 and 130 in concentrated regions may lead to localized heating effects and/or a less uniform axial magnetic field.

Figure 4:
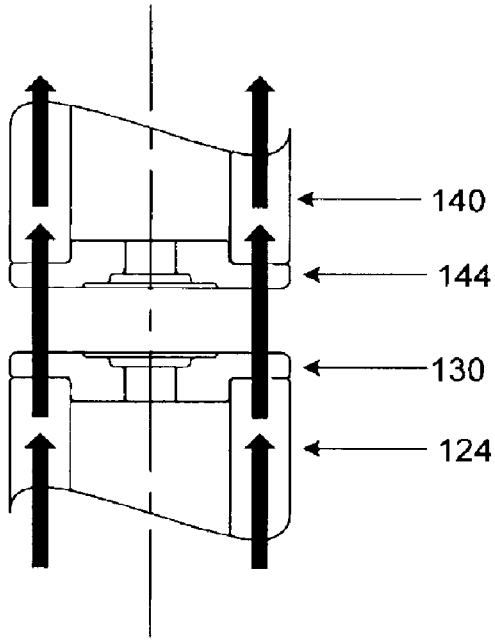
FIG. 4 is a block diagram illustrating current flow in the vacuum interrupter of FIG. 1.

FIG. 4 demonstrates a typical flow of current through vacuum fault interrupter of FIG. 1. As shown in FIG. 4, current flow is generally uniform through the portions of coil segments 124 and 140 which contact electrical contacts 130 and 144, respectively. Coil segments 124 and 140 are typically composed of a copper tube. The copper tube should ensure that a cross section between slots 128 and 144 (note that slots 128 and 144, shown in FIG. 1, are not explicitly illustrated in FIG. 4) is sufficient to carry high magnitude fault currents traversing the vacuum fault interrupter. As a result, particularly for high-magnitude fault currents, very thick or "heavy-walled" copper tubes may be employed.

However, such heavy-walled copper tubes are generally not ideal for ensuring desirable current flow, that is, current flow which is concentrated as much and as close as possible to an outside diameter of the tube. This is due to the magnitude of the magnetic field being determined by an amount of the current enclosing the field in the copper tubes. That is, since the current is flowing through the walls of the tube, there is less current enclosing the magnetic field at an edge of the tube than there is within an inner diameter of the tube. As a result, the field peaks at a center of the tube, and decreases to zero at the outer perimeter of the walls. In a thin-walled tube, the magnetic field peak is lower and the rate of drop-off towards the outside diameter is less. Also, since the inside diameter is closer to the outside diameter (and is thus larger) in a thin-walled tube, this drop-off occurs closer to the outside diameter of the tube, ensuring a larger area with a uniform magnetic field. Uniformity of the magnetic field is thus generally inversely related to the thickness of the walls of the tube.

Figure 5:
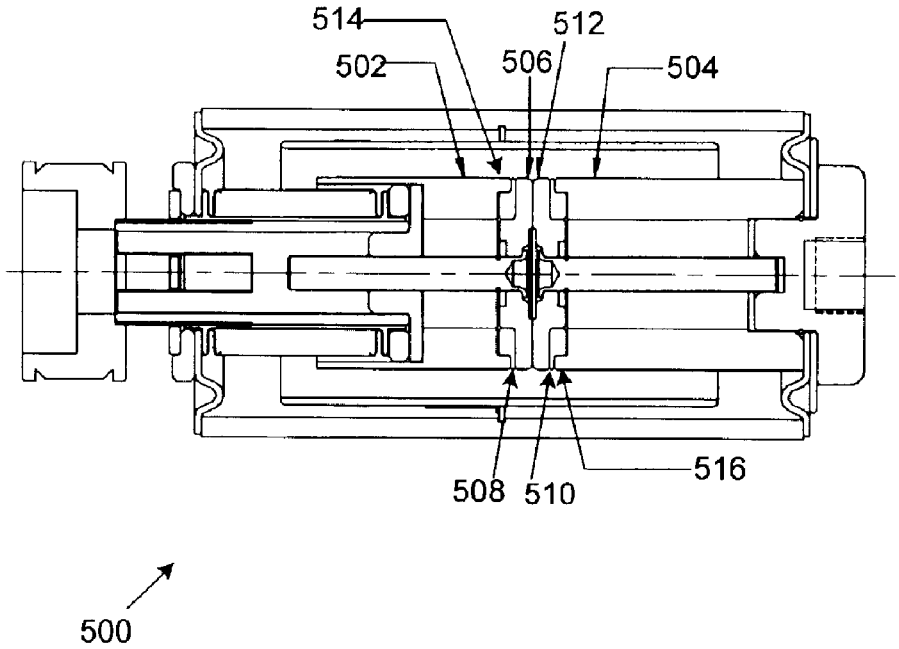
FIG. 5 is a cutaway side view of a vacuum interrupter.

FIG. 5 demonstrates a vacuum fault interrupter 500 that is similar in structure to the fault interrupter 100 of FIG. 1. Note that portions of FIG. 5 not explicitly discussed in the following discussion or above with respect to FIG. 1 are discussed in more detail below with respect to FIGS. 10 and 12. In FIG. 5, a stainless steel ring 508 is placed between coil segment 502 and contact 506 (which correspond to coil segment 140 and contact 142). Similarly, a stainless steel ring is also placed between coil segments 504 and contact 512.

Coil segment 502 includes a small counterbore that produces a longitudinal protrusion 514 that extends from the end of the coil segment around the perimeter of the coil segment. Similarly, coil segment 504 has a counterbore that produces a longitudinal protrusion 516 at the end of that coil segment. Thus, each coil has a constant outer diameter and an inner diameter that increases at the protrusion. Techniques other than counterboring may be used to produce the same results. For example, the coil segments may be cast or forged using a mold that defines the protrusions.

Stainless steel rings 508 and 510 each have a volume resistivity higher than those of their respective coil segments and the electrical contacts, such that current flow through the rings is uniformly spread through the copper at the end of the coil segments, and uniformly enters the contacts. Stainless steel rings 508 and 510 may be composed of for example, a non-magnetic stainless steel, such as AISI 304.

Because the current does not enter the contacts immediately at the end of the slots in the electrode structure, a longer current path is created. As a result, a magnitude of the axial magnetic field is increased. Also, because of the uniform spreading of the current upon entering the contacts, localized heating at the contacts is reduced, and a uniformity of the axial magnetic field is correspondingly improved. Finally, the presence of the relatively high resistivity ring also serves to reduce any losses in the axial magnetic field which may result from the presence of eddy currents. For example, in the vacuum fault interrupter 100 of FIG. 1, eddy currents may momentarily travel around coil segment 124, and momentarily skip around slot 128 (via contact 130) and back into coil segment 124; in the vacuum fault interrupter 500 of FIG. 5, the high-resistivity ring(s) 508/510 prevent this behavior. Additionally, the presence of the high-resistivity (impedance) ring(s) 508/510 in FIG. 5 reduces a conductive cross section available to eddy currents, by taking up space that is filled by the contacts 130 and 142 and/or the coil segments 124 and 140 in FIG. 1.

Because the above-recited features result from the relatively high resistivity of the stainless steel rings 508 and 510, other materials with similarly high resistivities may also be used to obtain the advantages. For example, certain copper-chrome or copper-nickel alloys (such as Monel) could also be used. Additionally, another way to increase an impedance (although not a resistivity) presented to the current is to increase a diameter of the counter bore (i.e., use a narrow cross section on the end of the coil sections 108 and 140).

Additionally, protrusions 514 and 516 force the flow of current to an outside diameter of the coil segments and contacts. As a result, despite the use of heavy-walled copper in constructing coil segments 502 and 504, a uniform axial magnetic field may nevertheless be obtained.

Figure 6:
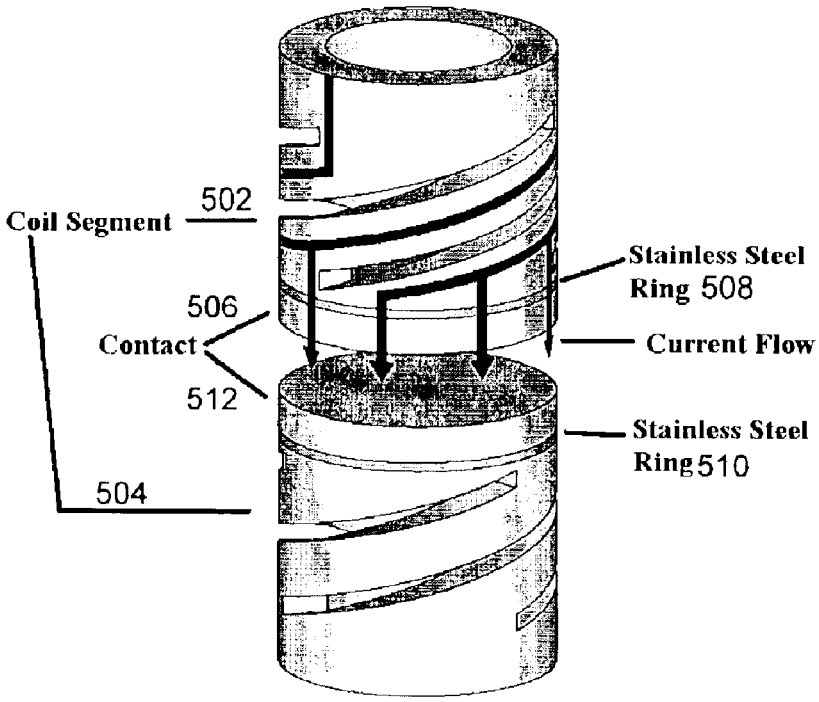
FIG. 6 is a perspective view illustrating current flow through the vacuum fault interrupter of FIG. 5.
Figure 7:
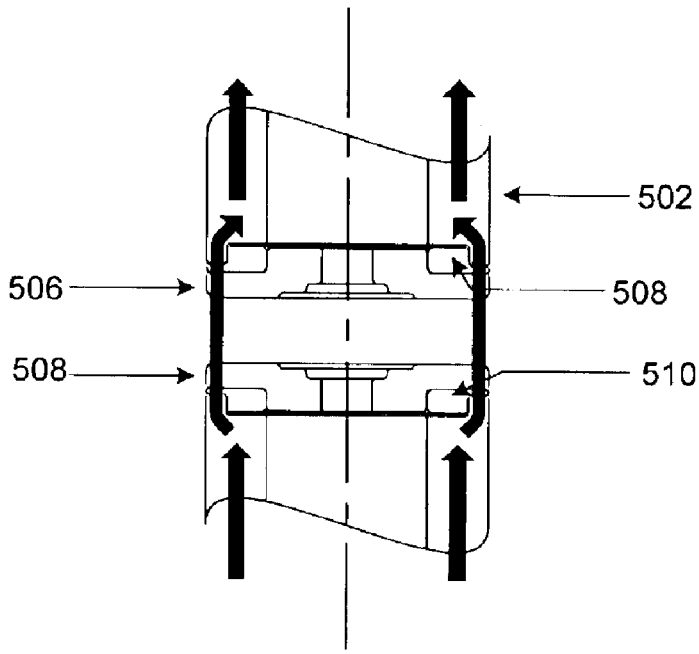
FIG. 7 is a block diagram illustrating current flow through the vacuum interrupter of FIG. 5.

FIG. 6 demonstrates a current flow through the vacuum fault interrupter of FIG. 5. In FIG. 6, it should be understood that current flow occurs uniformly between the coil segments due to the presence of steel rings 508 and 510. FIG. 7 demonstrates a cross section of current flow through the vacuum interrupter of FIG. 5. As shown in FIG. 7, current flow is forced to an outside diameter of coil segments 124 and 140, which increases the uniformity of an axial magnetic field between the electrodes.

Figure 8A:
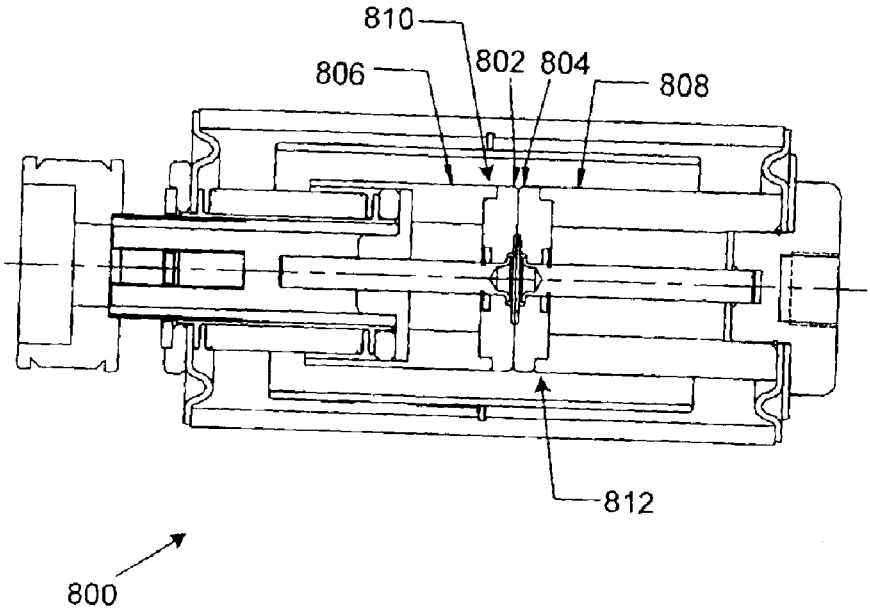
FIG. 8A is a cutaway side view of a vacuum interrupter.

FIG. 8A demonstrates a vacuum interrupter 800 that is similar to the vacuum interrupter 500 of FIG. 5. Each of coil segments 806 and 808 includes a counterbore and a corresponding ring-shaped protrusion 810 or 812. However, stainless steel rings like the rings 508 and 510 are not included.

Figure 8B:
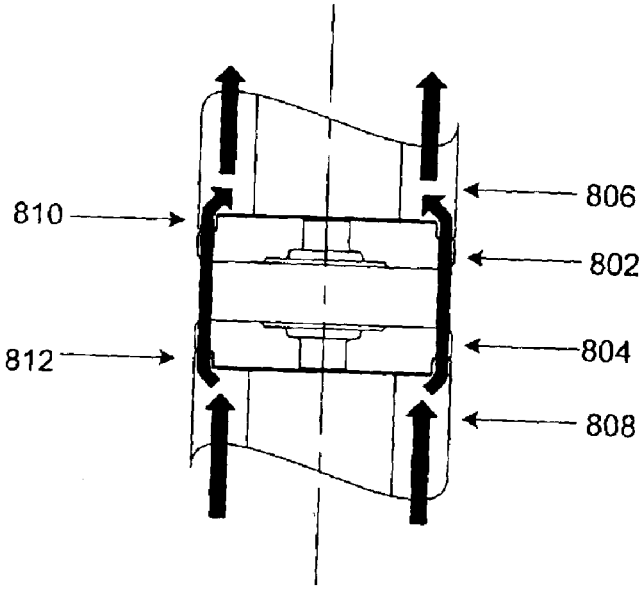
FIG. 8B is a block diagram illustrating current flow through the vacuum interrupter of FIG. 8A.

FIG. 8B illustrates current flow in the implementation of FIG. 8A. In FIG. 8B, as in FIGS. 5–7, current is forced to an outside perimeter of coil segment 808 by virtue of portions 810 and 812. This is true aside from the fact that no stainless steel rings or other impedance is placed between coil segments 806, 808 and electrical contacts 802, 804, respectively. In FIGS. 8A and 8B, it should be apparent that contacts 802 and 804 are shaped differently than contacts 506 and 512. Specifically, contacts 802 and 804 each have a portion within the counterbore of coil segments 806 and 808 that extends throughout essentially the entire diameter of the counterbore, and has direct contact with all of the interior surfaces at the ends of the coil segments 806 and 808, including those of ring-shaped protrusions 810 and 812.

Figure 9A:
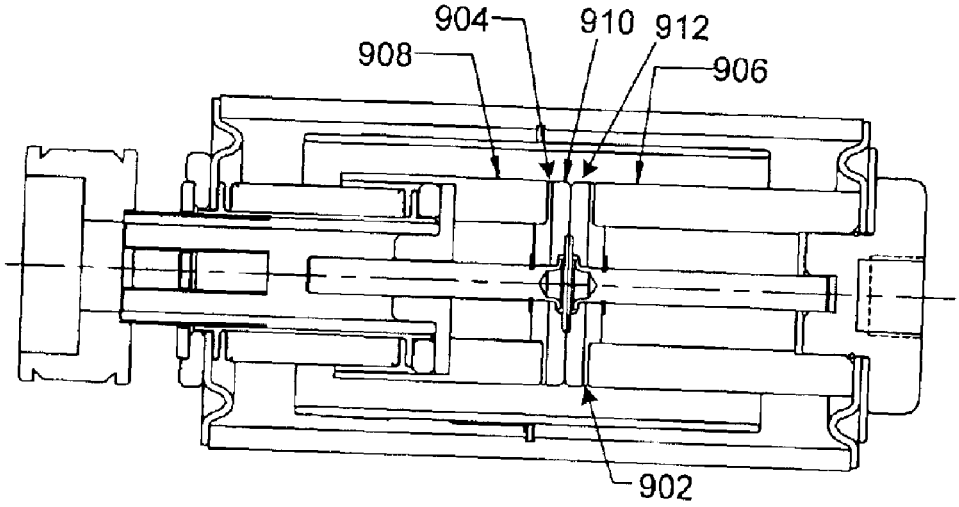
FIG. 9A is a cutaway side view of a vacuum interrupter.

Conversely, FIG. 9A demonstrates an implementation of the vacuum interrupter of FIG. 5 in which there is no counter bore in the coil segments 906 and 908. Rather, coil segments 906 and 908 have flush ends, against which steel rings or other high resistivity rings 902 and 904 are situated between the coil segments 906 and 908 and the contacts 912 and 910, respectively.

Figure 9B:
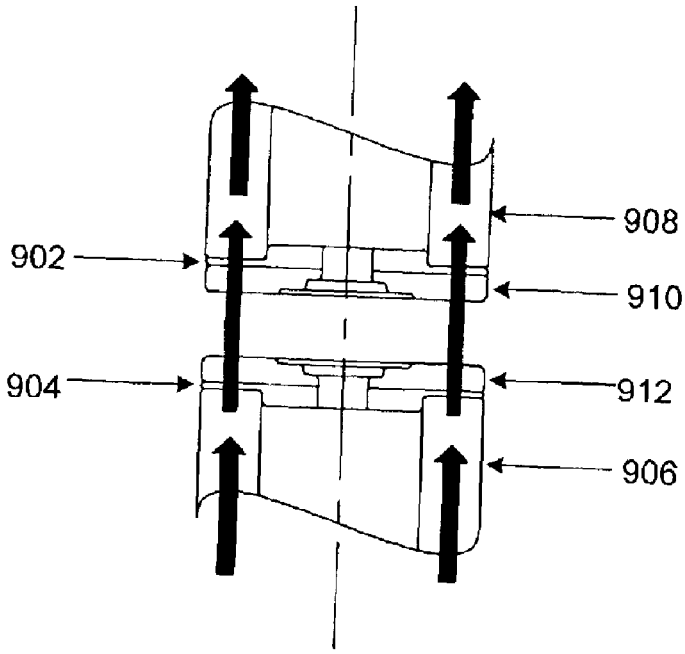
FIG. 9B is a block diagram illustrating current flow through the vacuum interrupter of FIG. 9A.

FIG. 9B illustrates current flow in the implementation of FIG. 9A. In FIG. 9B, current is dispersed by the presence of rings 902 and 904, and therefore travels evenly through contacts 910 and 912, as well as through coil segments 906 and 908. In this way, the current path is effectively lengthened, resulting in a higher axial magnetic field and less localized heating at the contacts 910 and 912.

Use of the vacuum interrupters of FIGS. 5, 8 and 9 is governed by particular needs of a user of the interrupter. For example, the assembly of the formation of FIGS. 8A and 8B may obviate any cost and assembly-related difficulties associated with rings 508 and 510. Conversely, machining of the coil segments 906 and 908 of the vacuum interrupter of FIGS. 9A and 9B may be eased by the nature of the flush end of the coil segments 906 and 908 with respect to steel rings 902 and 904.

Figure 10:
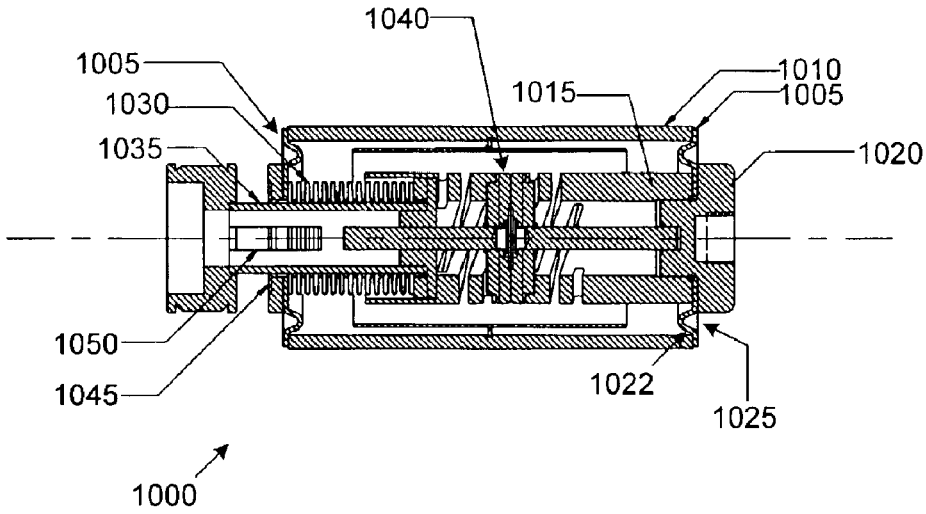
FIG. 10 is an alternate implementation of a vacuum interrupter.

FIG. 10 illustrates an alternate implementation of a vacuum interrupter 1000. In FIG. 10, an end cap 1005 serves to help maintain an integrity of a vacuum seal of vacuum interrupter 1000. End cap 1005 is attached to ceramic 1010 (which forms a substantially cylindrical hollow body), cylindrical structure 1015, and conductive segment 1020. In this implementation, conductive segment 1020 is a female-threaded connector for connecting to a male-threaded connector and thereby to an external circuit. Compared to external conductive rod 116 of FIG. 1, segment 1020 provides a more stable base upon which the vacuum interrupter of FIG. 10 may need to rest during an assembly of the vacuum interrupter.

Additionally, end cap 1005 includes a loop or continuously curved portion 1022 that provides several advantages. For example, in the vacuum interrupter of FIG. 1, end caps 112 and 113 are generally fixtured during assembly of the vacuum interrupter, and thereby held in place while being brazed to the metallized surface on ceramic 104. This is necessary since the brazing is a fluid process, and the end caps 112 and 113 might float out of position if not held in place by fixtures. Nonetheless, such fixtures are often elaborate and, particularly with respect to a level of cleanliness that must be preserved throughout the brazing process, extremely difficult to maintain. Moreover, such fixtures are often difficult to maintain mechanically as well, often loosening over time until they fail to secure their associated portions of the vacuum interrupter tightly enough to ensure functionality.

As the vacuum interrupter cools from the brazing cycle (approximately 700–800° C.), a difference in the coefficients of linear thermal expansion between ceramic 104 (approximately $6–8\times10^{-6}$ inches/inches° C.) and end cap 112 (approximately $1–2\times10^{-6}$ inches/inches° C.) may cause end cap 112 to bow inward, thereby changing the overall length of the vacuum interrupter. Moreover, the amount of this bowing tends to vary, making it difficult to predict a final length of a vacuum interrupter being assembled.

Additionally, end shield 114, which may be either attached to end cap 112 as shown in FIG. 1 or integral to end cap 112, serves to protect the triple joint (ceramic, metal, and vacuum) at each end of ceramic 104. Because the tip of end shield 114 has a relatively sharp point, end shield 114 tends to focus electrical stress (electric field), such that any burrs or discontinuities on the surface of end field 114 may cause a failure of the vacuum fault interrupter at high voltage.

In contrast, the rounded surface of the loop 1022 of the end cap 1005 in the vacuum interrupter of FIG. 10 produces a much lower electrical stress and thereby reduces the probability of a failure at high voltage. Furthermore, this loop acts as a radial spring that absorbs any differences in the coefficients of linear thermal expansion between the ceramic 1010 and metal end cap 1005. Since the end caps do not bow, the end length of the vacuum interrupter of FIG. 10 does not vary significantly. In anther example of an advantageous feature of the vacuum interrupter of FIG. 10, the loop-associated angles and radii leading to the loop from the outer flange surface (i.e., a flat area outside the loop) tend to be self aligning at braze temperature, so that elaborate fixturing is not necessary to hold the end cap in place until the end cap is brazed.

Figure 11A:
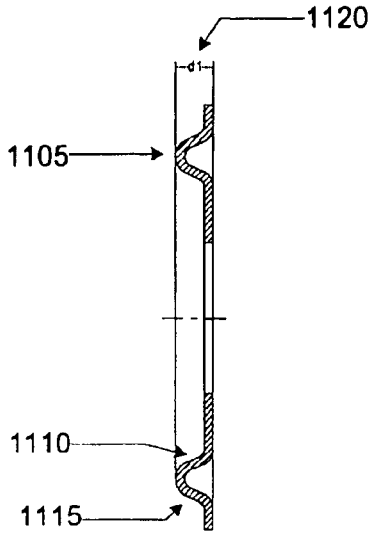
FIG. 11A is a sectional view of a first end cap for use with the vacuum interrupter of FIG. 10.
Figure 11B:
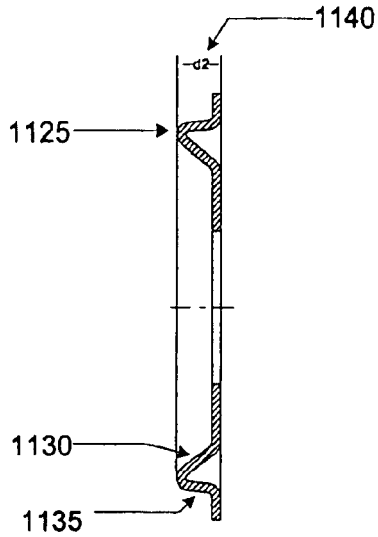
FIG. 11B is a sectional view of a second end cap for use with the vacuum interrupter of FIG. 10.
Figure 11C:
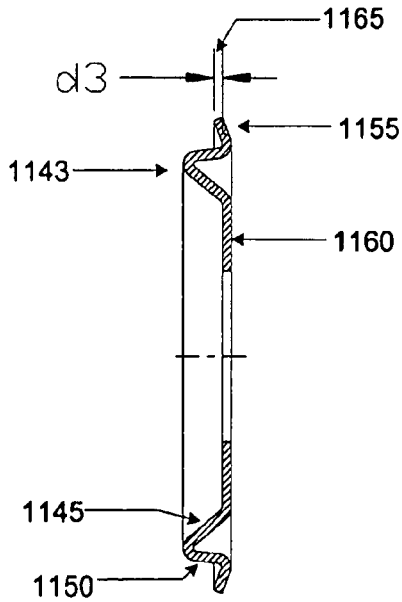
FIG. 11C is a sectional view of a third end cap for use with the vacuum interrupter of FIG. 10.

FIGS. 11A, 11B, and 11C illustrate three examples of loops that may be formed in the end caps 1005 of the vacuum interrupter of FIG. 10. In FIG. 11A, a loop 1105 is essentially perfectly rounded, so that portions 1110 and 1115 are substantially symmetrical, and define a distance "d1" 1120 that exists between a bottom of loop 1105 and a top plane of end cap 1005.

In FIG. 11B, a loop 1125 is less rounded and comes to a somewhat sharper point. In this case, portions 1130 and 1135 may be of different lengths, as shown. Also, a distance "d2" 1140 may be relatively larger than distance d1 1120. Increasing or decreasing the distance d1 1120 or d2 1140 may impact a spring constant of loop 1105 or 1125, respectively, as well as an amount of triple joint protection and shielding. Similarly, increasing or reducing a symmetry of loops 1105 and 1125 may also affect their respective spring constants, so that these factors may be adjusted as needed to obtain a desired result. Thus, as long as the loop does not form such a sharp point as to begin to act as an area of electric field concentration, thereby causing electrical discontinuities, a degree of concavity may be chosen by a designer in any manner thought to optimize the use of end cap 1005.

In FIG. 11C, a loop 1143 forming a continuously curving concave second portion is similar to the loop 1125 of FIG. 11B, with respect to a shape of portions 1145 and 1150. However, in FIG. 11C, an outer portion 1155 (i.e., an outer sealing flange of the end cap 1005, also referred to as a substantially annular first portion, or a substantially circular outer perimeter portion) is not completely co-planar with an inner portion 1160 (also referred to as a substantially annular third portion) of the end cap 1005, as is shown in FIGS. 11A and 11B. Rather, only a first section of the outer portion (i.e., first portion) 1155 is co-planar with the inner portion (i.e., third portion) 1160. A second section of the outer portion 1155 tapers away from a plane of the inner portion 1160, to define a distance "d3" 1165, and thus forms the outer portion 1155 into a slightly conical shape. In practice, the distance d3 1165 may be, for example, approximately 0.001 inches to .010 inches, and may not be visible to the naked eye (in FIG. 11C, a magnitude of the distance d3 1165 with respect to a size of the end cap 1005 is exaggerated for the sake of illustration). Although a portion of the outer portion 1155 is co-planar with the inner portion 1160 in FIG. 11C, the outer portion 1155 could also be formed so as to have no portion that is co-planar with the inner portion 1160, regardless of whether the outer portion 1155 is tapered in the manner of FIG. 11C.

Referring again to FIG. 10, cover portions 1025 may optionally be used to cover an open area formed by the presence of the loop in end cap 1005. This cover may be useful in situations in which the vacuum interrupter of FIG. 10 is to be molded within a solid dielectric (e.g., an epoxy material). In this way, an air cavity is maintained within the concavity formed by the loop in end cap 1005, so that the advantageous compression of end cap 1005 discussed above may also be realized for absorbing stresses associated with solid dielectrics, i.e., molding stresses. In other situations, such as when the vacuum interrupter is encased in oil, cover portions 1025 may not be necessary. In the context of, for example. FIG. 11C, the cover portions 1025 may be used to form a fourth portion that extends over the second portion 1140.

As referred to above with respect to FIG. 1, a motion of a moving rod 134, and its associated electrical contact 142, is maintained with a bellows 110. While very flexible, bellows 110 may also be quite fragile. Thus, after the vacuum interrupter of FIG. 1 is brazed together, there must be assurance that the moving rod 134, and thus the bellows 110, are not twisted, as this would damage the bellows 110.

To help avoid damage to bellows 1030 of FIG. 10, a slot 1050 is formed in a tubular portion of moving rod 1035. A substantially annular hollow guide 1045 having a plurality of ears (1302 in FIG. 13) is affixed to the end cap 1005, and these ears ride in the slot 1050 in the moving rod 1035, which extends along moving rod 1035 into the vacuum interrupter, past the end cap 1005. FIG. 13 demonstrates a cross-section view of moving rod 1035 showing guide 1045 taken along sectional line 13—13 shown in FIG. 12, and illustrating ears or protruding portions 1302. In FIG. 13, other elements of FIG. 12 are not shown, to thereby better illustrate the slotted nature of moving rod 1035 and guide 1045.

Figure 12:
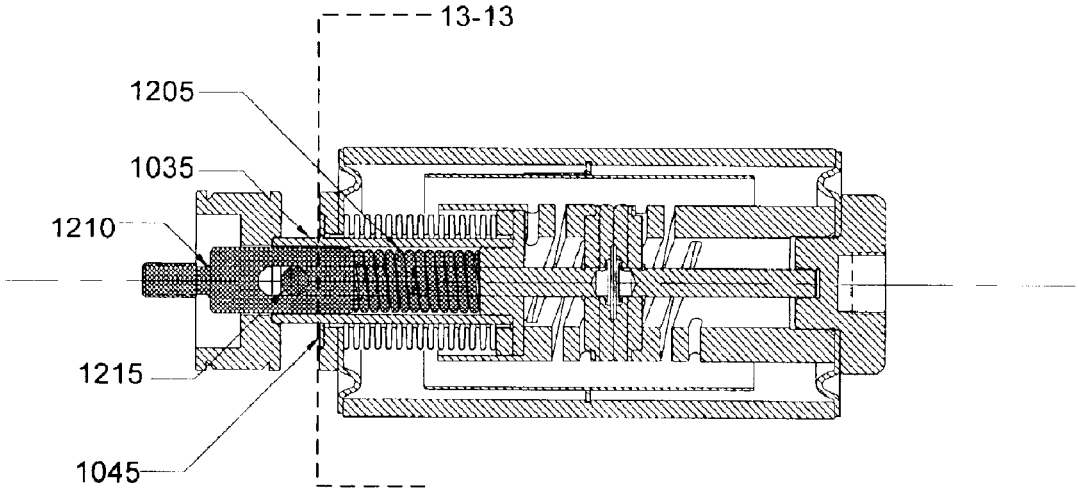
FIG. 12 is an alternate sectional view of the vacuum interrupter of FIG. 10.
Figure 13:
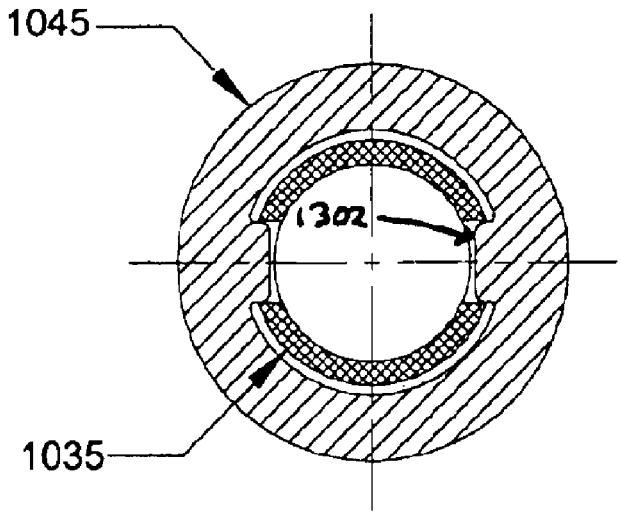
FIG. 13 is a cross-sectional view of the vacuum interrupter of FIG. 12 taken along section 13—13.

FIG. 12 illustrates the addition of a compression spring 1205 that is added and held in place via a spring holder 1210 that in turn is held in place by a roll pin 1215. The roll pin 1215 sits in slot 1050 (not seen in this figure). Actuation of the vacuum interrupter is transmitted through compression spring 1205. Through the assembly as described above and shown in FIGS. 10, 12, and 13, the moving rod 1035 is prevented from twisting and damaging the bellows during subsequent assembly operations, e.g., current exchange assembly or epoxy encapsulation, and little or no fixturing may be required to achieve this result.

A number of implementations have been described. Nevertheless, it will be understood that various modifications may be made. Accordingly, other implementations are within the scope of the following claims.

What is claimed is:

1. An end cover for a vacuum interrupter, the end cover comprising:

a substantially annular first portion, the first portion being attached to a substantially cylindrical hollow body of the vacuum interrupter;

a concave second portion, the second portion being concentric to the first portion and concave with respect to the body; and a substantially annular third portion, the third portion being concentric with the first portion, wherein at least a portion of the concave second portion is positioned along an axis defined between electrical contacts of the vacuum interrupter and a joint at which the end cover is attached to the hollow body, and wherein the axis defines an opening of a shield that encloses the electrical contacts, such that the concave second portion shields the joint from electrical stress associated with movement of the electrical contacts during an operation of the vacuum interrupter.

2. The end cover of claim 1 wherein at least a first section of the first portion is substantially in a plane of the third portion.

3. The end cover of claim 2 wherein all of the first portion is substantially in the plane of the third portion, and substantially perpendicular to the body.

4. An end cover for a vacuum interrupter, the end cover comprising:

a substantially annular first portion, the first portion being attached to a substantially cylindrical hollow body of the vacuum interrupter;

a concave second portion, the second portion being concentric to the first portion and concave with respect to the body; and a substantially annular third portion, the third portion being concentric with the first portion, wherein a section of the first portion is tapered away from a plane of the third portion, in a direction of the concave second portion, and attached to the body.

5. The end cover of claim 1 wherein the body is primarily composed of ceramic.

6. The end cover of claim 1 further comprising a fourth portion that extends over the second portion.

7. The end cover of claim 1 wherein the third portion is attached to a substantially cylindrical electrode support structure that is concentric with the body.

8. An end cover for a vacuum interrupter, the end cover comprising:

a substantially annular first portion, the first portion being attached to a substantially cylindrical hollow body of the vacuum interrupter;

a concave second portion, the second portion being concentric to the first portion and concave with respect to the body; and a substantially annular third portion, the third portion being concentric with the first portion, wherein a substantially annular hollow guide is attached to the third portion, the guide including protruding portions extending into an interior thereof, the protruding portions riding in corresponding slots formed in a moving rod that is slidable through the end cover and the guide and operable to actuate a moving electrode of the vacuum interrupter.

9. The end cover of claim 8 wherein the protruding portions are composed primarily of steel.

10. The end cover of claim 1 wherein the third portion is attached to, and sandwiched between, a support structure for an electrode of the vacuum interrupter and a female-threaded metallic base.

11. A vacuum interrupter having an end cover, the end cover comprising:

a substantially circular outer perimeter portion;

an inner portion that is concentric with the outer perimeter portion; and a continuously curved portion protruding into a body of the vacuum interrupter and joining the outer perimeter portion to the inner portion, wherein at least a portion of the continuously curved portion is positioned along an axis defined between electrical contacts of the vacuum interrupter and a joint at which the end cover is attached to an insulating body encasing the vacuum interrupter, and wherein the axis defines an opening of a shield that encloses the electrical contacts, such that the continuously curved portion shields the joint from electrical stress associated with movement of the electrical contacts during an operation of the vacuum interrupter.

12. The vacuum interrupter of claim 11 wherein the inner portion is substantially within a plane, and further wherein at least a first portion of the outer perimeter portion is substantially within the plane of the inner portion.

13. The vacuum interrupter of claim 12 wherein substantially all of the outer perimeter portion is substantially within the plane of the inner portion.

14. A vacuum interrupter having an end cover, the end cover comprising:

a substantially circular outer perimeter portion;

an inner portion that is concentric with the outer perimeter portion; and a continuously curved portion protruding into a body of the vacuum interrupter and joining the outer perimeter portion to the inner portion, wherein a portion of the outer perimeter portion is tapered away from a plane of the inner portion, in a direction of the curved portion, and attached to the insulating body of the vacuum interrupter.

15. The vacuum interrupter of claim 11 wherein the outer perimeter portion and the inner portion are substantially perpendicular to the insulating body of the vacuum interrupter.

16. The vacuum interrupter of claim 11 further comprising a covering portion that extends over the curved portion.

17. The vacuum interrupter of claim 11 wherein the inner portion is attached to a substantially cylindrical electrode support structure that is concentric with the body.

18. A vacuum interrupter having an end cover, the end cover comprising:

a substantially circular outer perimeter portion;

an inner portion that is concentric with the outer perimeter portion; and a continuously curved portion protruding into a body of the vacuum interrupter and joining the outer perimeter portion to the inner portion, wherein a substantially annular hollow guide is attached to the inner portion and includes protruding portions extending into an interior thereof, the protruding portions riding in corresponding slots formed in a moving rod that is slidable through the end cover and the guide and operable to actuate a moving electrode of the vacuum interrupter.

19. The vacuum interrupter of claim 11 wherein the inner portion is attached to, and sandwiched between, a support structure for an electrode of the vacuum interrupter and a female-threaded metallic base.

* * * * *